US005355822A

United States Patent [19]

Lemke

[11] Patent Number: 5,355,822

[45] Date of Patent: Oct. 18, 1994

[54] BUMPER FENDER

[76] Inventor: Stuart H. Lemke, 349 River Bluff Dr., Mosinee, Wis. 54455

[21] Appl. No.: 111,633

[22] Filed: Aug. 25, 1993

[51] Int. Cl.[5] ..... B63B 59/02

[52] U.S. Cl. ..... 114/219

[58] Field of Search ..... 114/219, 220, 221 R, 114/343, 361, 364

[56] References Cited

U.S. PATENT DOCUMENTS

| | | | |
|---|---|---|---|
| 3,988,997 | 11/1976 | Fenton | 114/219 |
| 4,653,419 | 3/1987 | Brandon | 114/219 |
| 4,706,991 | 11/1987 | Miller | 293/41 |
| 4,841,893 | 6/1989 | Ellison | 114/219 |
| 4,915,662 | 4/1990 | Kent | 114/219 |

*Primary Examiner*—Jesus D. Sotelo

*Attorney, Agent, or Firm*—Andrus, Sceales, Starke & Sawall

[57] ABSTRACT

A bumper fender includes a slip sheet disposed to be in contact with the dock when the boat is moored. A cushion sheet is connected to the slip sheet and disposed between the slip sheet and the boat hull. Elongated straps are disposed at the upper end of the bumper fender so that the assembly may be suspended along a portion of the boat hull. The cushion sheet and the slip sheet are connected at their upper ends so as to allow relative vertical movement between the slip sheet and the cushion sheet so as to minimalize the amount of slipping or rubbing action against the boat hull.

8 Claims, 2 Drawing Sheets

BUMPER FENDER

BACKGROUND OF THE INVENTION

The present invention relates to boat hull protectors and more specifically to a bumper fender that can be used to protect a boat hull when the boat is moored to a dock or another boat.

In the past, boat fenders have been made with a variety of materials and configurations to protect a boat from damage when moored at a dock.

The typical boat fender was round or cylindrical in shape and since it was merely suspended from its upper end from the boat, the motion of the boat tended to squeeze the fender out of its location so that the boat was allowed to come into contact with the dock. Even if the fender maintained its position, the rolling, sliding or scraping motion of the fender against the boat hull would mar the boat finish.

Woven or sheet-like fender covers have been used in the past, but these too tended to wear or mar the boat hull.

SUMMARY OF THE INVENTION

It is an object of the present invention to provide a simple, inexpensive and easily used bumper fender that can protect the boat finish when the boat is moored at a dock or other boat.

In accordance with one aspect of the invention, the bumper fender is provided with a slip sheet that is disposed to be in contact with the dock when the boat is moored.

In accordance with another aspect of the invention, a cushion sheet is connected to the slip sheet and disposed between the slip sheet and the boat hull.

In accordance with yet another aspect of the invention, fastening means are disposed at the upper end of one of the slip or cushion sheets so that the fender can be suspended along a portion of the boat hull.

In accordance with still another aspect of the invention, the cushion sheet and the slip sheet are connected at their upper ends so as to allow for relative vertical movement between the slip sheet and the cushion sheet so that the sliding or robbing motion between the cushion sheet and the boat is minimalized.

In accordance with still another aspect of the invention, ballast is provided in the lower end of the slip sheet to help maintain the suspended position of that sheet when the boat is moored.

In accordance with still another aspect of the invention, the fastening means are adjustable so that the position of the bumper fender along the boat hull may be varied.

The present invention thus provides a bumper fender that is easily used with many types of boats and which prevents a rubbing or sliding action between the bumper fender and the boat.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
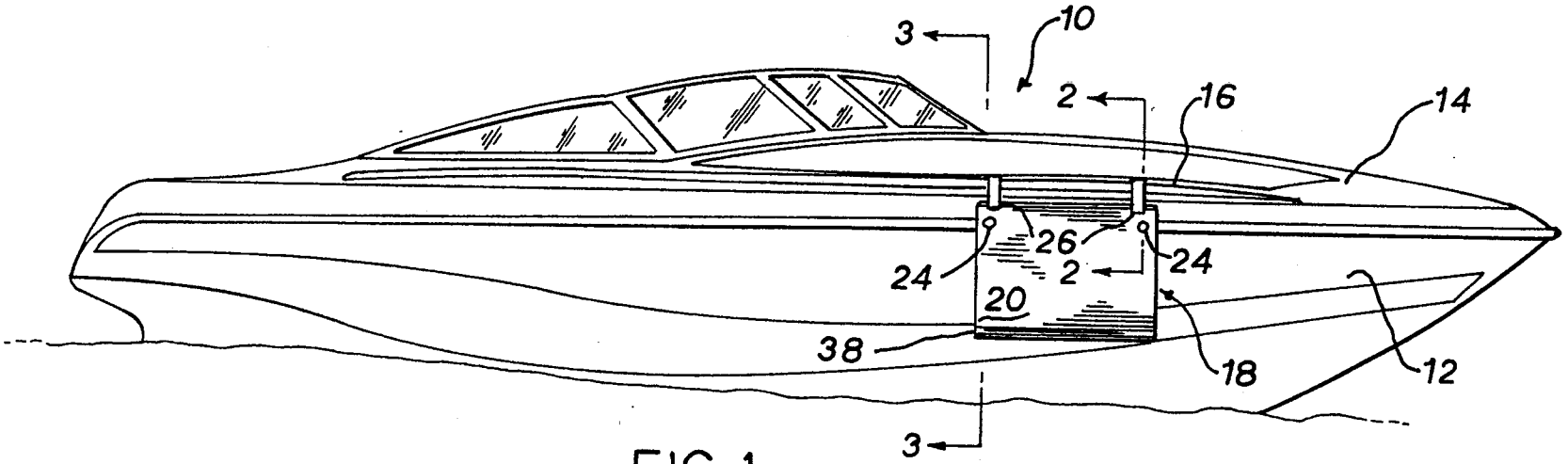
FIG. 1 is a perspective view of a boat utilizing the skid and bumper fender of the present invention.

FIG. 1 illustrates a boat 10 having a hull 12 and a deck 14 on which a railing 16 is mounted. A bumper fender 18 is attached to and suspended from railing 16.

Bumper fender 18 includes a substantially rectangular slip sheet 20 that is formed from a sheet of low friction elastomeric material. Slip sheet 20 is disposed on the outer side of bumper fender 18 so that it will be in contact with the dock (not shown) when boat 10 is moored.

A substantially rectangular cushion sheet 22 in the form of a resilient foam pad is connected to the upper portion of slip sheet 20 by a rivet 24 or other suitable fastening member. Cushion sheet 22 is disposed inwardly of slip sheet 20 so that it will be in contact with boat hull 12 if boat 10 shifts towards the dock while it is moored. Cushion sheet 22 is connected to Slip sheet 20 only at the upper end so that limited vertical movement between slip sheet 20 and cushion sheet 22 is allowed. Thus, up or down movement of the boat will result in the movement of slip sheet 20 along cushion sheet 22 rather than a slipping or rubbing motion of cushion sheet 22 on boat hull 12.

The upper edge 21 of slip sheet 20 is provided with a pair of slots 26 in which a pair of elongated fastening straps 28 are disposed. Each of fastening straps 28 is prodded with an adjustment buckle 30 that allows the length of adjustment strap 28 to be varied.

Upper edge 21 is also provided with a channel 23 in which plastic reinforcement rod 25 is disposed.

The upper end of fastening strap 28 has a pair of snap connectors 32 and 34 that releasably engage each other. When bumper fender 18 is utilized with a boat having a railing 16, the upper portion of fastening strap 28 is passed over and around railing 16 and snap connectors 32 and 34 are engaged so that bumper fender 18 will be suspended from boat railing 16. The position of bumper fender 18 along hull 12 can then be varied by changing the length of fastening strip 28 with adjustment buckle 30.

Figure 5:
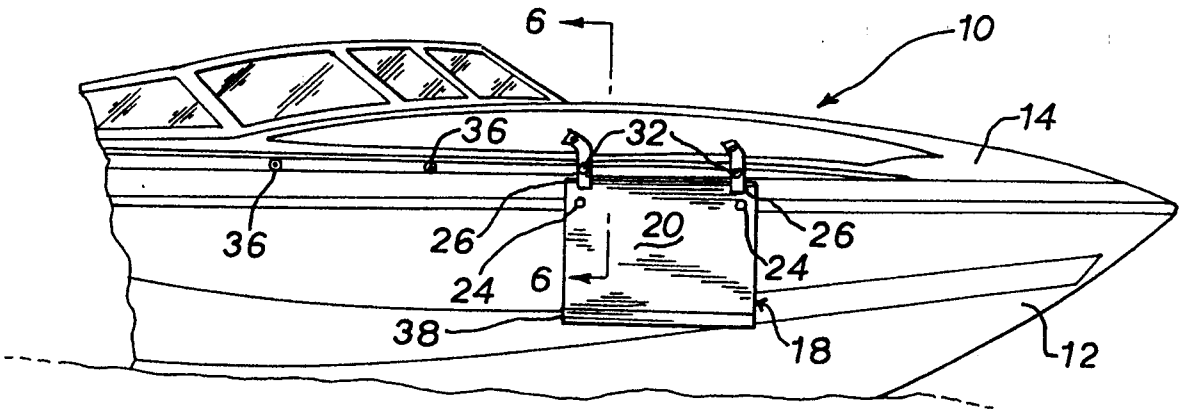
FIG. 5 is a perspective view of an alternate manner of attaching the invention to a boat.
Figure 2:
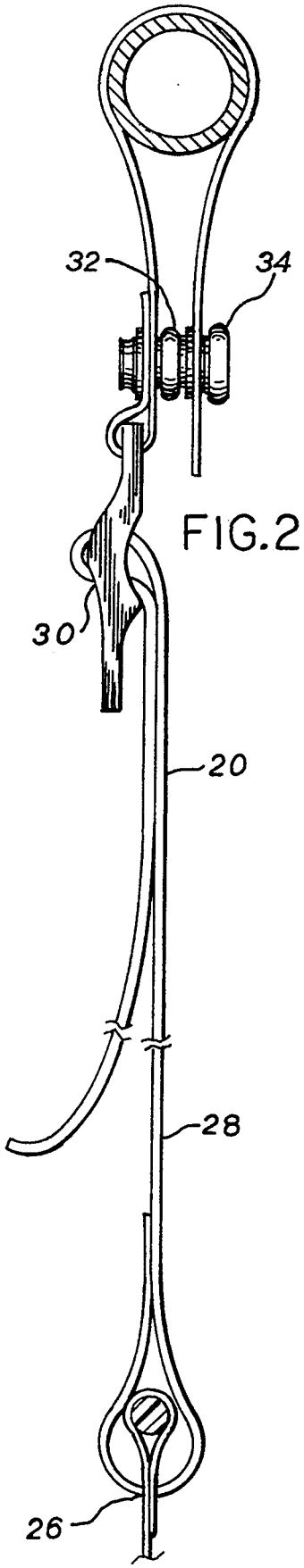
FIG. 2 is a sectional view along the line 2—2 of FIG. 1.
Figure 3:
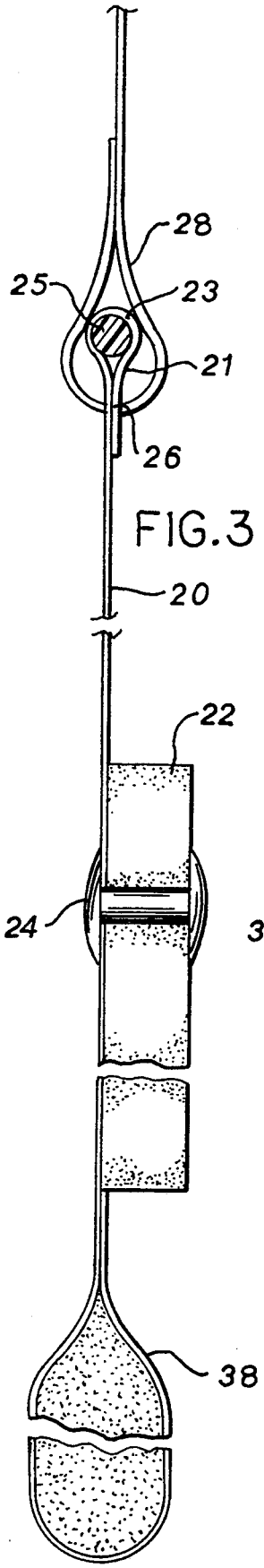
FIG. 3 is a sectional view along the line 3—3 of FIG. 1.
Figure 4:
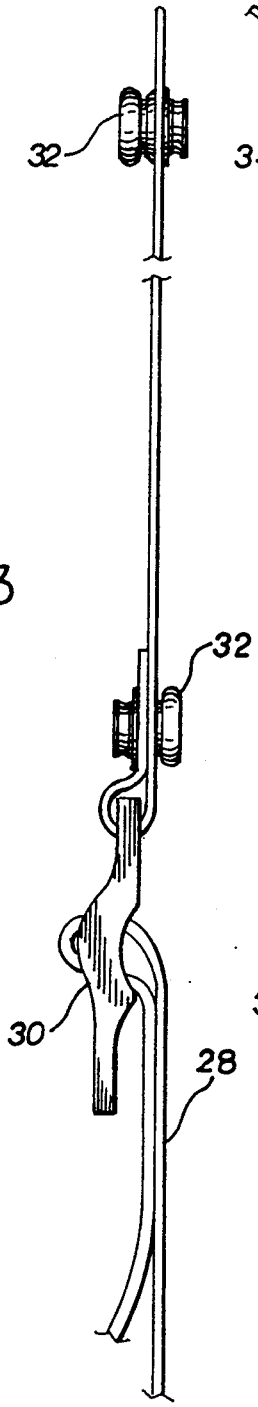
FIG. 4 is a side view of a boat skid and bumper fender constructed according to the present invention.
Figure 6:
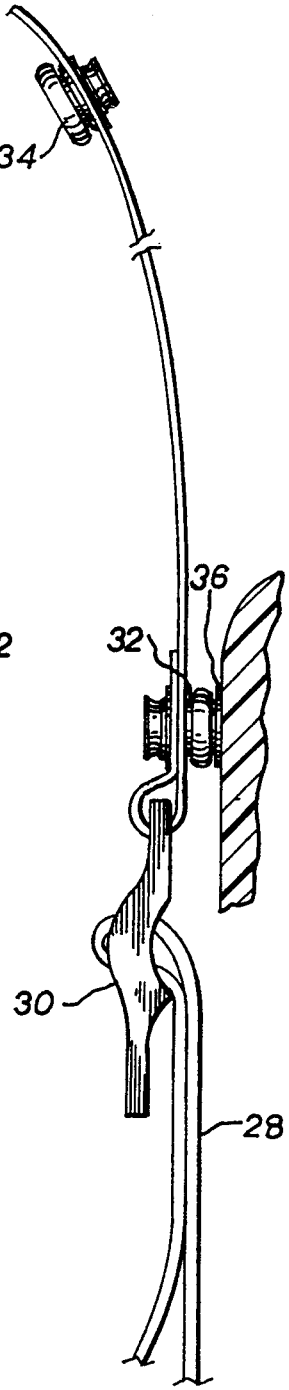
FIG. 6 is a sectional view along the line 6—6 of FIG. 5.

FIG. 5 illustrates a situation in which the boat is provided with a series of snap connectors 36 along its hull. In a situation such as this, snap connectors 32 on fastening strap 28 are merely connected to corresponding snap connectors 36 and the position of boat fender 18 is adjusted as described above.

Slip sheet 20 is also provided at its lower end with a section of ballast 38 that aids in maintaining the suspended position of boat fender 18 along hull 12.

The present invention thus provides a bumper fender assembly that is easy to use and mount on a number of types of boats and one in which the finish or paint on the hull is protected from the constant rubbing or slipping motion typically associated with boat fenders.

Various modes of carrying out the invention are contemplated as being within the scope of the following claims particularly pointing out and distinctly claiming the subject matter regarded as the invention.

I claim:

1. A bumper fender assembly to protect a boat hull when moored at a dock, said assembly comprising:

a slip sheet disposed to be in contact with the dock when the boat is moored, said slip sheet having an upper and lower horizontal edge, a cushion sheet connected to said slip sheet adjacent said upper horizontal edge so that said cushion sheet hangs from said upper edge of said slip sheet and is disposed between said slip sheet and the boat hull, fastening means disposed at the upper end of one of said slip or cushion sheets for suspending said assembly along a portion of the boat hull, said cushion sheet being in contact with the boat hull and following the up and down movement of the hull while said slip sheet contacts the dock and slides along the surface of said cushion sheet as the boat hull moves up and down.

2. The assembly defined in claim 1 further comprising ballast means disposed in a lower portion of said assembly to maintain said suspended position of said assembly when fastened to the boat hull.

3. The assembly defined in claim 2 wherein said ballast means are disposed in a lower portion of said slip sheet.

4. The assembly defined in claim 1 wherein said fastening means comprises an elongated strap extending from one of said slip or cushion sheets for encircling engagement with a railing of the boat.

5. The assembly defined in claim 4 further comprising adjustment mans disposed on said strap for selectively varying the length of said strap.

6. The assembly defined in claim 4 further comprising a pair of snap connectors disposed on said strap and engageable with each other to define a loop around the boat railing.

7. The assembly defined in claim 4 further comprising a snap connector disposed on said strap and engageable with a mating connector on the surface of the boat.

8. A bumper fender assembly to protect a boat hull when moored at a dock, said assembly comprising:

a slip sheet disposed to be in contact with the dock when the boat is moored, said slip sheet having an upper and lower horizontal edge, a cushion sheet connected to said slip sheet adjacent said upper horizontal edge so that said cushion sheet hangs from said upper edge of said slip sheet and is disposed between said slip sheet and the boat hull, fastening means disposed at the upper end of one of said slip or cushion sheets for suspending said assembly along a portion of the boat hull, said cushion sheet being in contact with the boat hull and following the up and down movement of the hull while said slip sheet contacts the dock and slides along the surface of said cushion sheet as the boat hull moves up and down, and ballast means disposed in a lower portion of said slip sheet to maintain said suspended position of said assembly when fastened to the boat hull.

* * * * *